US009682472B2

(12) United States Patent
Chang et al.

(10) Patent No.: US 9,682,472 B2
(45) Date of Patent: Jun. 20, 2017

(54) APPARATUS FOR ACCOMMODATING SCREWS AND A SCREW DRIVER

(71) Applicant: ScienBiziP Consulting (Shen Zhen) Co., Ltd., Shenzhen (CN)

(72) Inventors: Yin-Li Chang, New Taipei (TW); Guo-Liang Yeh, New Taipei (TW)

(73) Assignee: ScienBiziP Consulting(Shenzhen)Co., Ltd., Shenzhen (CN)

( * ) Notice: Subject to any disclaimer, the term of this patent is extended or adjusted under 35 U.S.C. 154(b) by 49 days.

(21) Appl. No.: 14/716,496

(22) Filed: May 19, 2015

(65) Prior Publication Data

US 2016/0136804 A1 May 19, 2016

(30) Foreign Application Priority Data

Nov. 13, 2014 (TW) ..... 103220177 U

(51) Int. Cl.
*B65D 25/10* (2006.01)
*B25H 3/00* (2006.01)

(52) U.S. Cl.
CPC ..... *B25H 3/006* (2013.01)

(58) Field of Classification Search
CPC ..... B25H 3/006; B25H 3/003; B25H 3/04; B65D 25/10; B65D 73/0064
USPC ..... 206/349, 372–383, 566, 6.1
See application file for complete search history.

(56) References Cited

U.S. PATENT DOCUMENTS 4,396,121 A * 8/1983 Lemmon ..... A47F 7/03 206/566
5,117,971 A * 6/1992 Fisher ..... A47F 7/03 206/486
6,257,409 B1 * 7/2001 Lin ..... B25H 3/04 206/376
7,121,407 B2 * 10/2006 Hurt ..... A01K 97/06 206/373
7,946,418 B1 * 5/2011 Cerynik ..... B25H 3/021 206/350
2003/0183591 A1 * 10/2003 Ling ..... A47F 7/00 211/70.6
2005/0098461 A1 * 5/2005 Kao ..... B25H 3/04 206/372
2005/0133394 A1 * 6/2005 Liu ..... A45C 11/00 206/349
2011/0297568 A1 * 12/2011 Miller ..... B65D 73/0064 206/375

* cited by examiner

*Primary Examiner* — Chun Cheung
(74) *Attorney, Agent, or Firm* — Steven Reiss

(57) ABSTRACT

An accommodating apparatus configured for accommodating screws and a screw driver includes a sleeve and a support. The sleeve defines a receiving hole, and a sidewall of the sleeve defines a fixing groove in communication with the receiving hole. The support includes an accommodating plate, and the accommodating plate includes two opposing clamping blocks for clamping the screw driver, and a protrusion corresponding to the fixing groove. The accommodating plate has a mounting surface, and the support defines a plurality of through holes in the mounting surface for receiving the screws. The protrusion is releasably-engagable with the fixing groove, thereby enabling the accommodating plate to be received in the receiving hole of the sleeve, and further enabling the accommodating plate to be disengaged from the sleeve.

12 Claims, 7 Drawing Sheets

APPARATUS FOR ACCOMMODATING SCREWS AND A SCREW DRIVER

FIELD

The subject matter herein generally relates to an accommodating apparatus, and particularly, to an accommodating apparatus for accommodating screws and a screw driver.

BACKGROUND

Screws are commonly used for assembling products, such as electronic devices. As the screws are small, the screws need to be accommodated in an accommodating device when detaching or assembling products. Moreover, a screw driver for fixing the screws also needs to be accommodated.

BRIEF DESCRIPTION OF THE DRAWINGS

Implementations of the present technology will now be described, by way of example only, with reference to the attached figures.

DETAILED DESCRIPTION

Figure 1:
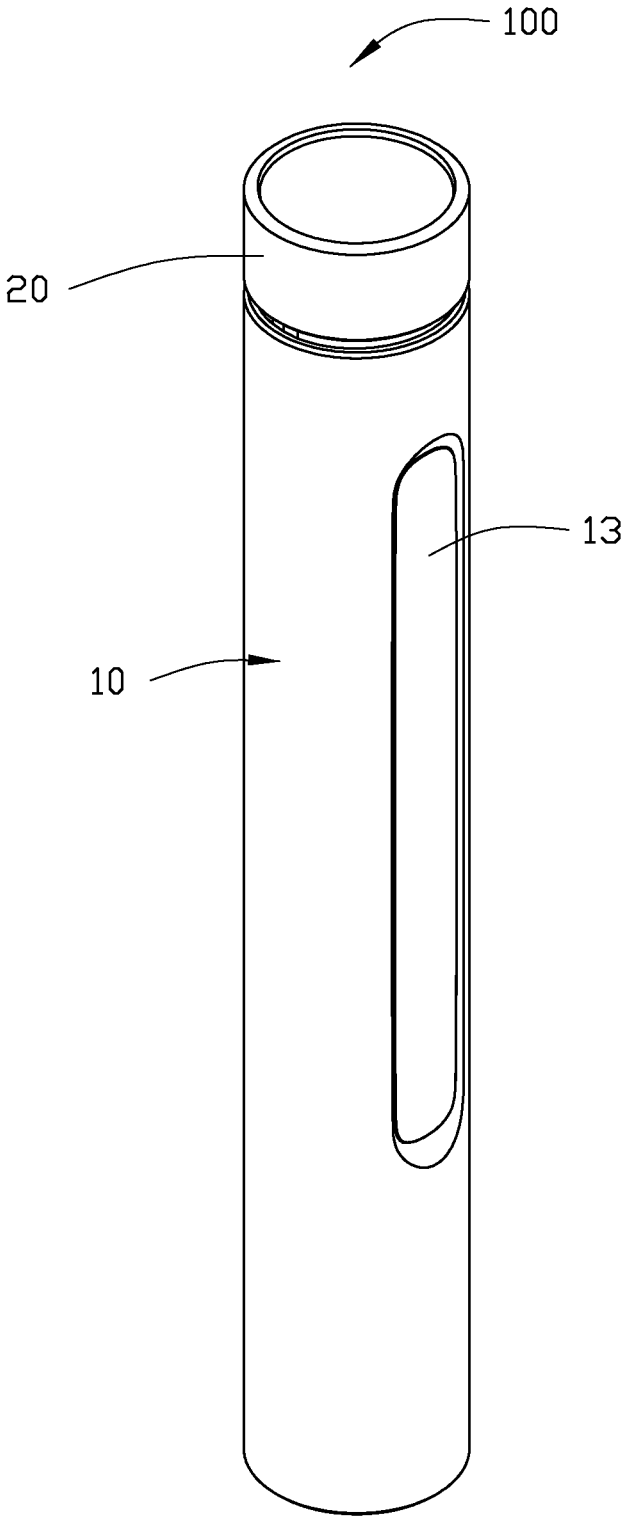
FIG. 1 is an isometric view of an embodiment of an accommodating apparatus.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

The present disclosure is relation to an accommodating apparatus configured for accommodating screws and a screw driver.

FIG. 1 illustrates that an accommodating apparatus 100 of one embodiment of this disclosure can include a sleeve 10 and a support 20 partially received in the sleeve 10. The main body 10 can define a perspective plate 13.

Figure 2:
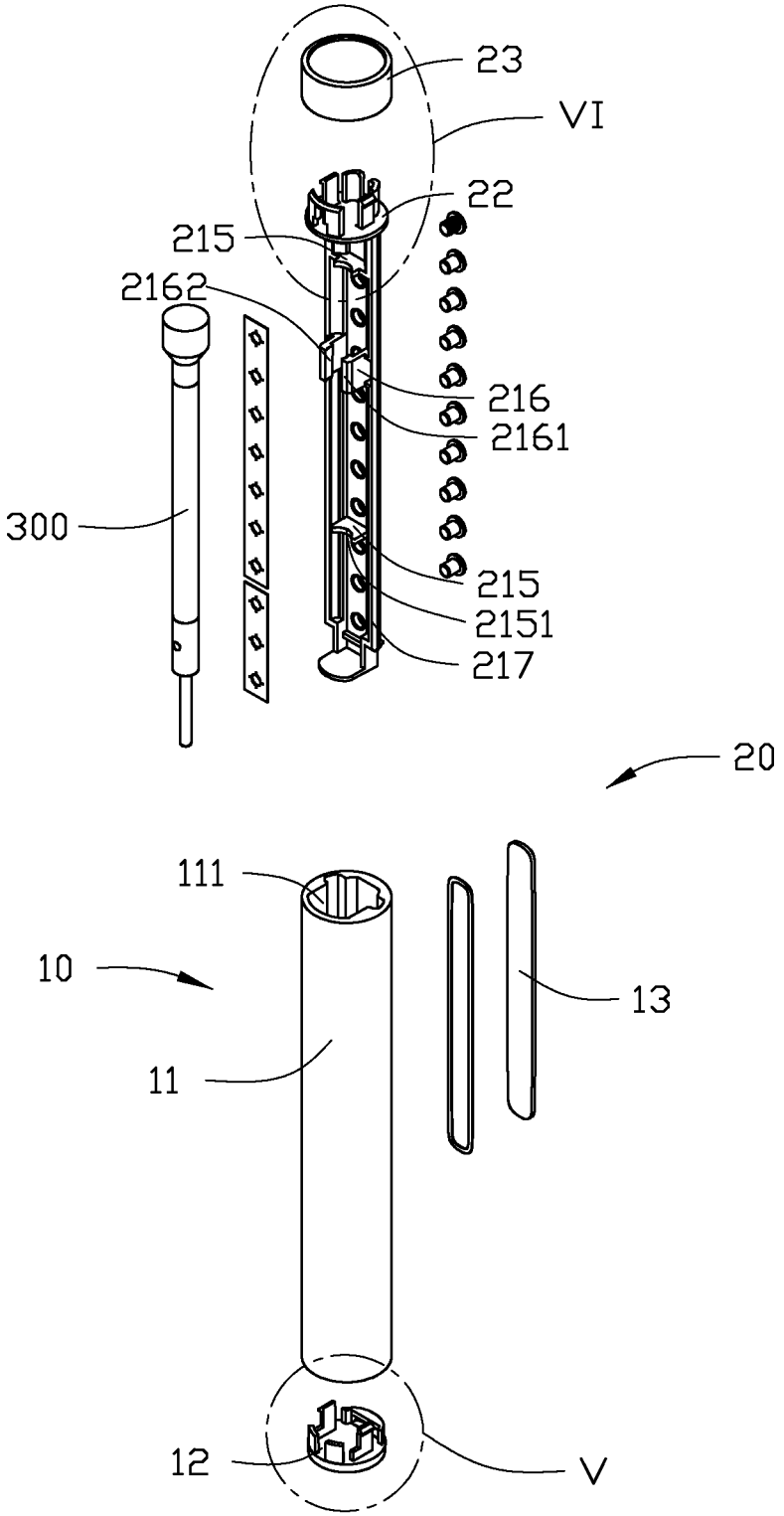
FIG. 2 is an exploded, isometric view of the accommodating apparatus shown in FIG. 1.
Figure 3:
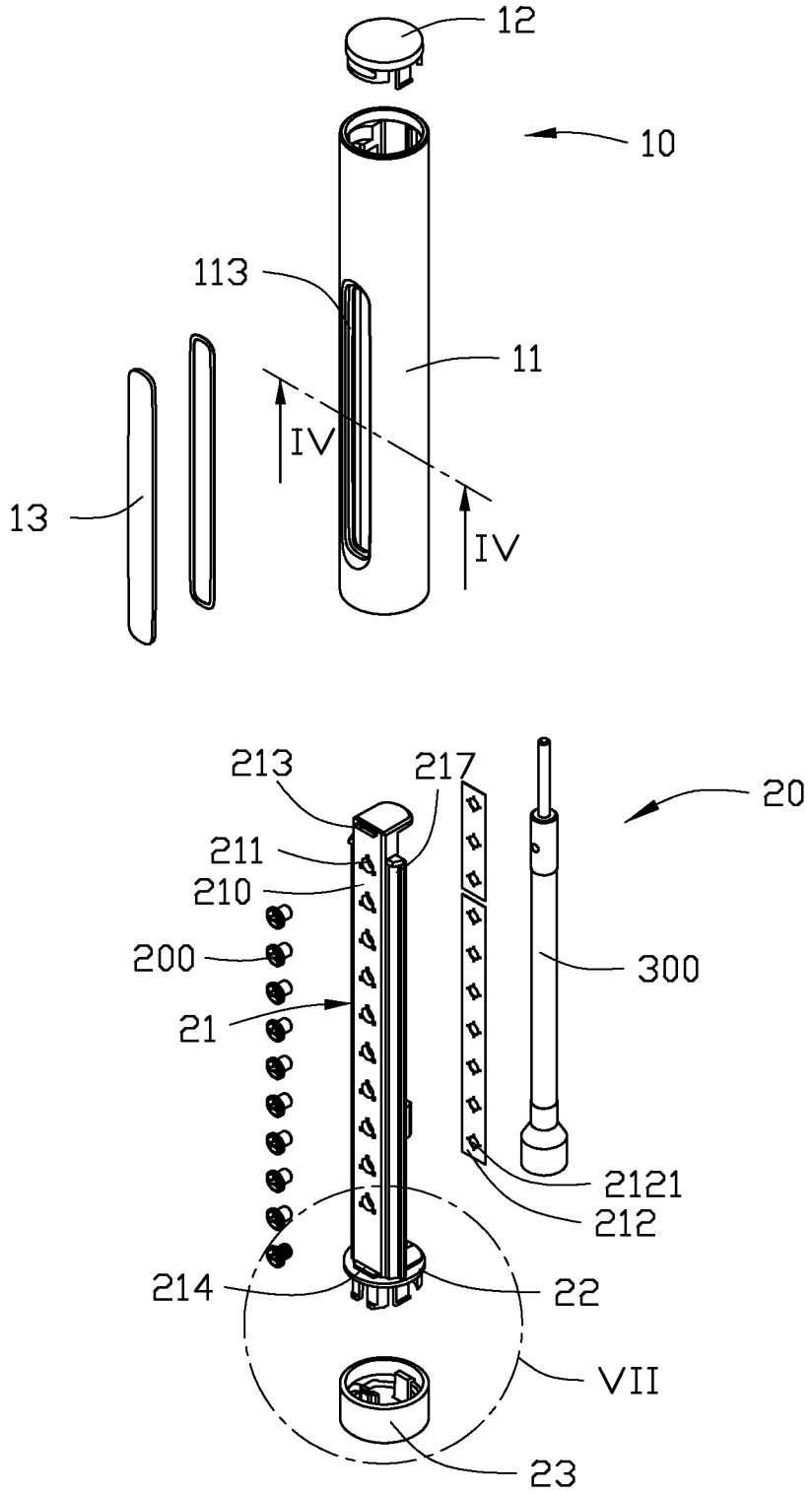
FIG. 3 is an exploded, isometric view of the accommodating apparatus shown in FIG. 1 viewed from another angle.

FIG. 2 and FIG. 3 illustrate that the sleeve 10 can include a main body 11 and a cover 12 coupled to the main body 11. The main body 11 can define a receiving hole 111 through thereof and extending along an axis of the main body 10. A circumference surface of the main body 11 can define a window 113 through thereof, and the perspective plate 13 can be mounted to the circumference surface of the main body 11 to close the window 113. Users can look into the sleeve 10 through the perspective plate 13.

The support 20 can include an accommodating plate 21, a circular plate 22 connected to one end of the accommodating plate 21, and a housing 23 coupled to the circular plate 22. The accommodating plate 21 can have a mounting surface 210, and the mounting surface 210 can define a plurality of through holes 211 for receiving screws 200. In other embodiments, the number of the through hole 211 can be one. The support 20 can further include a gasket 212 coupled to a surface of the accommodating plate 21 away from the mounting surface 210. The gasket 212 can define a plurality of threaded holes 2121 corresponding to the through holes 211 and configured for engaging with the screws 200. The screws 200 can run through the through holes 211 and be threaded to the threaded holes 2121, thus the screws 200 can be received in the accommodating plate 21. One end of the accommodating plate 21 away from the circular plate 22 can include a protrusion 213 with a chamfer. One end of the accommodating plate 21 adjacent to the circular plate 22 can include a fastening portion 214, and the fastening portion 214 can be in closely contact with an inner wall of the main body 11, such that the support 20 would not shake relative to the sleeve 10.

One side of the accommodating plate 21 away from the mounting surface 210 can include one or more stoppers 215 and one or more clamping blocks 216. In at least one embodiment, the number of the stoppers 215 and the clamping blocks 216 are two. One end of the stopper 215 away from the accommodating plate 21 can define a curved recess 2151, and one end of the clamping block 216 away from the accommodating plate 21 can include a clamping portion 2161. The two clamping blocks 216 can be positioned at two sides of the accommodating plate 21 and facing to each other. Each clamping block 216 can define a curved recess 2162, and the curved recesses 2162 can face to each other. A screw drive 300 can be clamped by the clamping blocks 216, and received in the curved recesses 2151 and 2161, thus the screw driver 300 can be fixed at the accommodating plate 21.

In other embodiments, the stoppers 215 and the clamping blocks 216 can be positioned at the mounting surface 210.

The mounting surface 210 of the accommodating plate 21 can define a guiding rail 217 along an axis of the sleeve 10.

Figure 4:
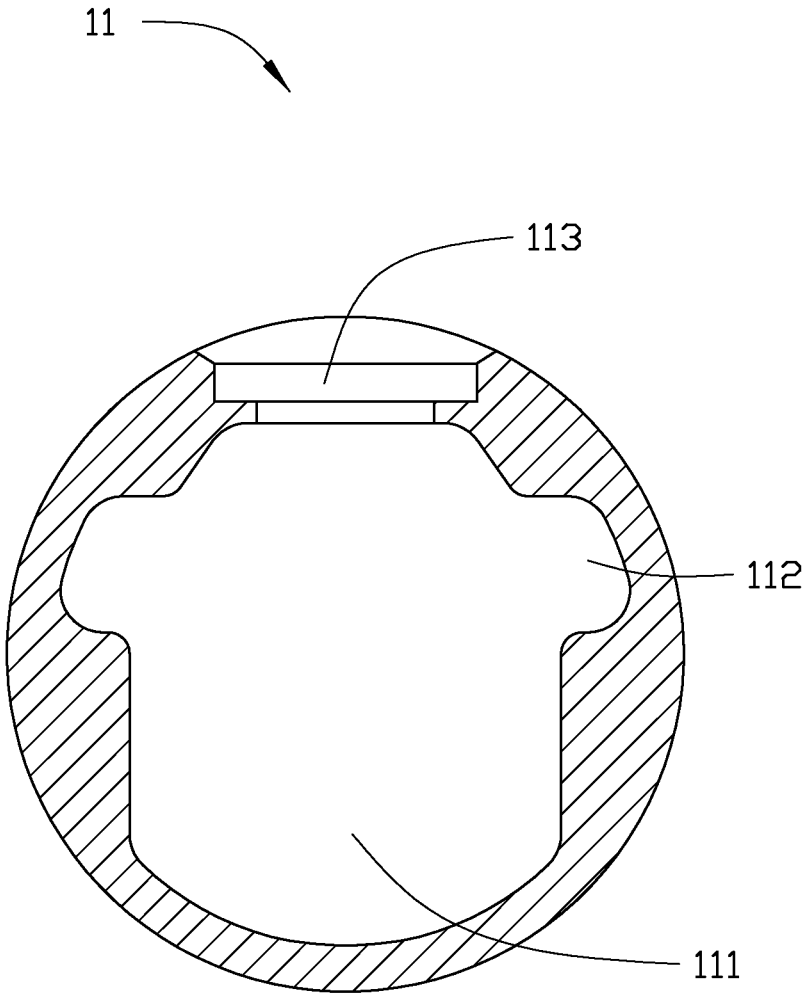
FIG. 4 is a sectional view of a main body of the accommodating apparatus taken along a line IV-IV shown in FIG. 3.

FIG. 4 illustrates that main body 11 can further define two receiving grooves 112. The receiving grooves 112 can be in communication with the receiving hole 111, and positioned at two sides of the receiving hole 111. The receiving grooves 112 can be positioned corresponding to the guiding rails 217 (shown in FIG. 3), and the support 20 can be received in the receiving hole 111 by the guiding rails 217. The guiding rails 217 can be received in the receiving grooves 112, and the accommodating plate 21 can be slidably received in the sleeve 10.

Figure 5:
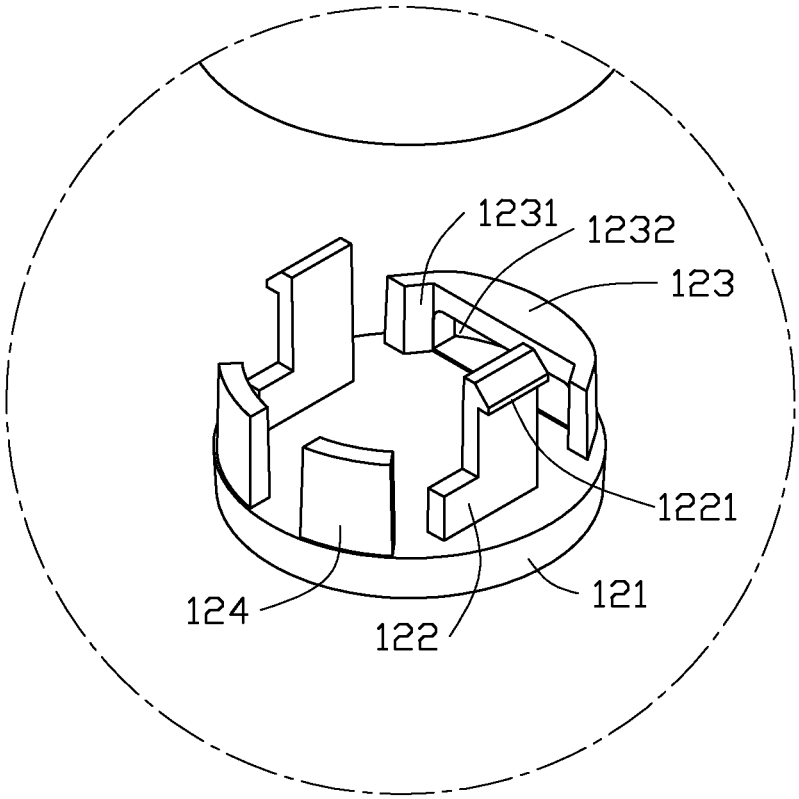
FIG. 5 is an enlarged view of a portion V of the accommodating apparatus shown in FIG. 2.

FIG. 5 illustrates that the cover 12 can include a base 121, a first fixture block 122, and a first fixing block 123. One end of the first fixture block 122 away from the base 121 can include a clasp 1221. The clasp 1221 can extend into the receiving hole 111 and be engaged to a latch groove (not shown) in the main body 11, thus the cover 12 can be received in the main body 11 to close one end of the receiving hole 111. The first fixing block 123 can be positioned at periphery of base 121 and act as a part of a sidewall of the cover 12. The first fixing block 123 can be curved. One end of the first fixing block 123 adjacent to a central of the base 121 can define a trapezoid groove 1231, and the trapezoid groove 1231 can define a fixing groove 1232 through the first fixing block 123. The fixing groove 1232 can be in communication with the receiving hole 111. The protrusion 213 (shown in FIG. 3) can be releasably-engagable with the fixing groove 1232, thereby enabling the accommodating plate 21 to be received in the receiving hole 111 of the sleeve 10, and the support 20 can be mounted in the sleeve 10. Furthermore, the accommodating plate 21 is capable of disengaged from the sleeve 10. In at least one embodiment, the cover 12 can further include a first protrusion block 124. The first protrusion block 124 can extend into the receiving hole 111, thus the cover 12 would not rotate relative to the cover 12. The first fixture block 122, the first fixing block 123, and the first protrusion block 124 can be positioned at one side of the base 121 and spaced from each other.

In other embodiments, the main body 11 can be coupled to the cover 12 by other means. For example, the main body 11 can be integrally formed with the cover 12.

Figure 6:
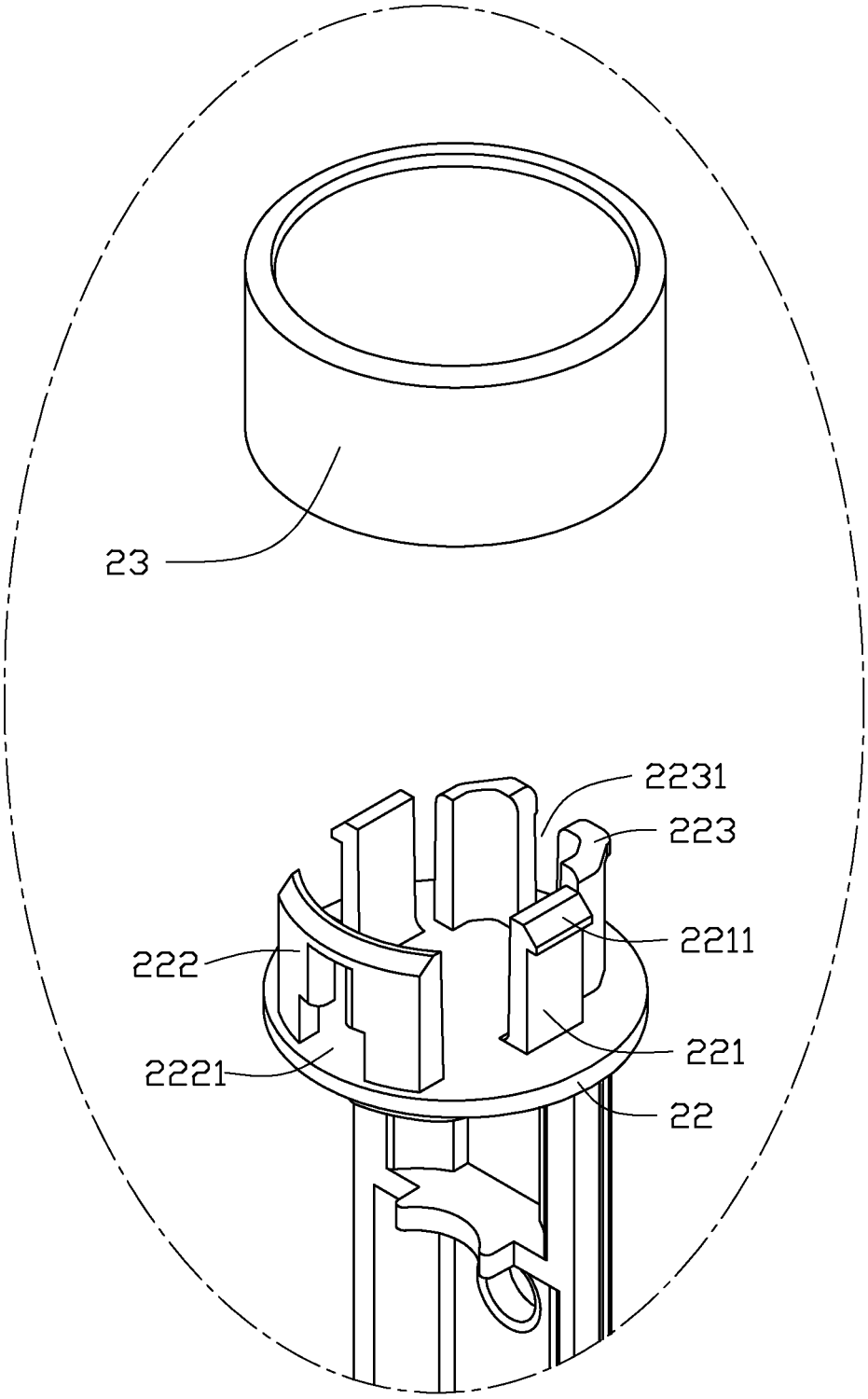
FIG. 6 is an enlarged view of a portion VI of the accommodating apparatus shown in FIG. 2.

FIG. 6 illustrates that one side of the circular plate 22 away from the accommodating plate 21 can include a second fixture block 221, a second fixing block 222, and a second protrusion block 223. One end of the second fixture block 221 away from the circular plate 22 can include a second clasp 2211, and the second fixing block 222 can define a latching groove 2221 away from a center of the circular plate 22. The second protrusion block 223 can define a slide groove 2231.

Figure 7:
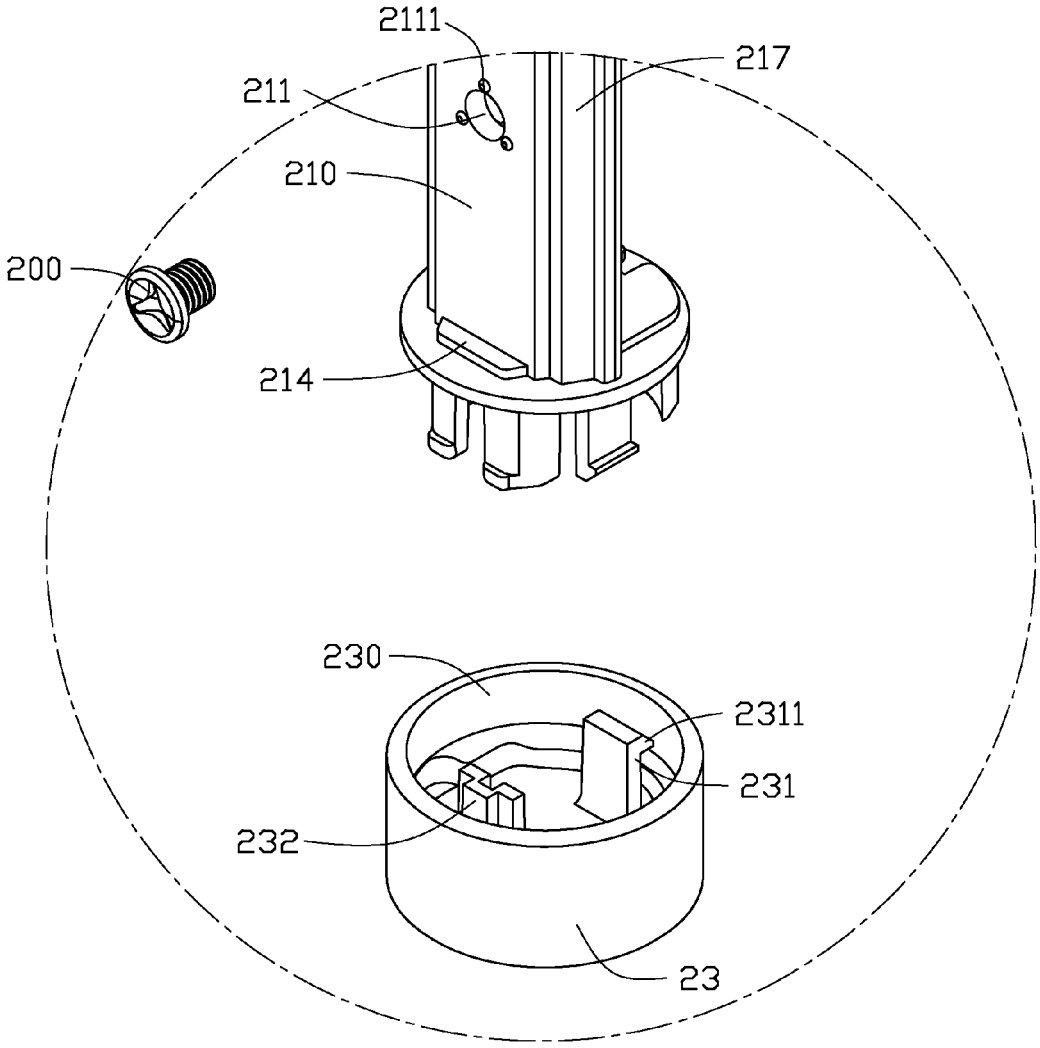
FIG. 7 is an enlarged view of a portion VII of the accommodating apparatus shown in FIG. 3.

FIG. 7 illustrates that the housing 23 can define a receiving chamber 230 and include a third fixture block 231 and a convex block 232 protruding from the receiving chamber 230. The third fixture block 231 can include a third clasp 2311, and the receiving chamber 230 can include a latching groove (not shown). Referring to FIG. 6 and FIG. 7, the second clasp 2211 can be clasped in the latching groove of the housing 23, the third clasp 2311 can be engaged to the latching groove 2221 of the circular plate 22, and one end of the convex block 232 can be received in the slide groove 2231 of the circular plate 22, thus the housing 23 can be coupled to the circular plate 22. When the accommodating plate 21 is totally received in the receiving hole 111, the circular plate 22 can close one end of the receiving hole 111. The accommodating plate 21 can be pulled out of the main body 11 by pulling the housing 23 away from the sleeve 10.

The mounting surface 210 can include three protrusion portions 2111 around the through hole 211. The protrusion portions 2111 can be configured to abut the screw 200 inserted into the through hole 211. When the screw 200 is received in the through hole 211, a screw cap of the screw 200 can be spaced from the accommodating plate 21, thus users can take out the screw 200 by manual. In at least one embodiment, the number of the protrusion portion 2111 can be at least one.

In assembly, the cover 12 can be received in and fixed at one end of the main body 11, and the perspective plate 13 can be mounted to the main body 11 to close the window 113. The gasket 212 can be mounted at one end of the accommodating plate 21 way from the mounting surface 210, and the housing 23 can be coupled to the circular plate 22. Then, one end of the accommodating plate 21 away from the circular plate 22 can be received in the receiving hole 111, and the two guiding rails 217 can be coupled to the two receiving grooves 112, thus the support 20 can be gradually received in the receiving hole 111, until the protrusion 213 is engaged with the fixing groove 1232. At this time, the accommodating apparatus 100 can be assembled.

In use, the housing 23 can be pulled away from the sleeve 10, and the protrusion 213 disengages with the fixing groove 1232. The screw 200 can run through the through hole 211 and be threaded to the gasket 212, and the screw cap of the screw 200 contact with the protrusion portion 2111. The screw driver 300 can be clamped by the clamping portions 2161 of the clamping block 216 and received in the curved recesses 2151 and 2163, thus the screw driver 300 can be fixed to the accommodating plate 21. One end of the accommodating plate 21 away from the circular plate 211 can be inserted to the sleeve 10, until the protrusion 213 is engaged with the fixing groove 1232. At this time, the screw 200 and the screw driver 300 can be received in the accommodating apparatus 100.

In taking out the screw 200 or the screw driver 300, the support 20 can be pulled out of the sleeve 10, and the screw 200 or the screw driver 300 can be taken off from the support 20.

The accommodating apparatus can include the support for fixing both the screw and the screw driver. The protrusion can be clasped by the fixing groove, such that the support can be received in the sleeve, and the screws and the screw driver can be accommodated in the accommodating apparatus.

The embodiments shown and described above are only examples. Many details are often found in the art such as the other features of an accommodating apparatus configured for accommodating screws and a screw driver. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, comprising in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An accommodating apparatus configured for accommodating screws and a screw driver, the accommodating apparatus comprising:

a sleeve comprising:

a main body defining a receiving hole, the receiving hole running through the main body; and a cover coupled to one end of the main body, the cover comprising a base, a first fixture block, and a first fixing block, the first fixture block and the first fixing block being coupled to one end of the base, and the first fixing block defining a fixing groove in communication with the receiving hole; and a support comprising an accommodating plate, the accommodating plate comprising:

two opposing clamping blocks configured to clamp the screw driver, and a protrusion corresponding to the fixing groove;

wherein the accommodating plate has a mounting surface, and the mounting surface defines a plurality of through holes for receiving the screws; and wherein the protrusion is releasably-engagable with the fixing groove, thereby enabling the accommodating plate to be received in the receiving hole of the sleeve, and further enabling the accommodating plate to be disengaged from the sleeve.

2. The accommodating apparatus as claimed in claim 1, wherein the cover further comprises a first protrusion block coupled to the base, and the first fixing block and the first protrusion block are positioned at the same end of the base.

3. The accommodating apparatus as claimed in claim 1, wherein the support further comprises a gasket positioned at a surface of the accommodating plate away from the mounting surface; and wherein the gasket defines a plurality of threaded holes corresponding to the through holes, and the threaded holes are configured for engaging with the screws.

4. The accommodating apparatus as claimed in claim 3, wherein the accommodating plate further comprises at least one protrusion portion on the mounting surface around each of the through holes, and the at least one protrusion portion is configured to abut the screw inserted into the through hole.

5. The accommodating apparatus as claimed in claim 1, wherein the main body of the sleeve further defines two receiving grooves in communication with the receiving hole, and the accommodating plate further comprises two guiding rails on the mounting surface along an axis of the sleeve; and wherein the guiding rails are received in the receiving grooves, and the accommodating plate is slidably received in the sleeve.

6. The accommodating apparatus as claimed in claim 1, wherein the support further comprises a circular plate coupled to one end of the accommodating plate, and the circular plate is configured to close the receiving hole when the accommodating plate is totally received in the receiving hole.

7. The accommodating apparatus as claimed in claim 6, wherein the support further comprises a housing coupled to one end of the circular plate away from the accommodating plate, and the housing is capable of pulling the accommodating plate out of the sleeve when being pulled away from the sleeve.

8. The accommodating apparatus as claimed in claim 7, wherein one end of the accommodating plate adjacent to the circular plate comprises a fastening portion, and the fastening portion is in closely contact with an inner wall of the main body when the accommodating plate is received in the sleeve.

9. The accommodating apparatus as claimed in claim 8, wherein the circular plate comprises a second fixture block defining a latching groove, a second fixing block, and a second protrusion block defining a slide groove; and wherein the housing defines a receiving chamber and comprises a third fixture block and a convex block protruding from the receiving chamber, the third fixture block is engaged to the latching groove of the circular plate, and one end of the convex block is received in the slide groove of the circular plate.

10. The accommodating apparatus as claimed in claim 1, wherein an circumference surface of the main body defines a window through thereof, and the sleeve further comprises a perspective plate mounted to the circumference surface of the main body to close the window.

11. The accommodating apparatus as claimed in claim 1, wherein the two clamping blocks are positioned at one side of the accommodating plate away from the mounting surface, one end of each of the clamping blocks away from the accommodating plate comprises a clamping portion, and the clamping portion defines a curved recess; and wherein the screw driver is clamped by the clamping portion and received in the curved recess to connected to the accommodating plate.

12. The accommodating apparatus as claimed in claim 1, wherein one side of the accommodating plate away from the mounting surface further comprises two stoppers spaced from each other, and each of the stoppers comprises a curved portion.

* * * * *